US010086310B2

(12) United States Patent
Semling

(10) Patent No.: US 10,086,310 B2
(45) Date of Patent: Oct. 2, 2018

(54) FLEXIBLE INTERCONNECTABLE BLOCK AND FASTENER SYSTEM

(71) Applicant: Brian Semling, Fountain City, WI (US)

(72) Inventor: Brian Semling, Fountain City, WI (US)

( * ) Notice: Subject to any disclaimer, the term of this patent is extended or adjusted under 35 U.S.C. 154(b) by 0 days.

(21) Appl. No.: 15/369,387

(22) Filed: Dec. 5, 2016

(65) Prior Publication Data

US 2018/0154275 A1 Jun. 7, 2018

(51) Int. Cl.
*A63H 33/10* (2006.01)
*A63H 33/08* (2006.01)

(52) U.S. Cl.
CPC ..... *A63H 33/101* (2013.01); *A63H 33/102* (2013.01); *A63H 33/086* (2013.01)

(58) Field of Classification Search
CPC .... A63H 33/062; A63H 33/065; A63H 33/08; A63H 33/04; A63H 33/086; B29C 65/58
USPC ..... 24/17 AP; 446/108, 109, 116, 124, 125, 446/107
See application file for complete search history.

(56) References Cited

U.S. PATENT DOCUMENTS 2,499,898 A * 3/1950 Anderson ..... A44B 18/0053 128/DIG. 15
2,791,868 A * 5/1957 Viken ..... A63H 33/062 428/11
3,242,610 A * 3/1966 Christiansen ..... A63H 33/086 446/128
3,604,145 A * 9/1971 Zimmerman ..... A63H 33/065 24/16 PB
3,895,456 A * 7/1975 Fabre ..... A63H 33/062 446/109
3,961,398 A * 6/1976 Herterich ..... A44B 18/0019 24/401
4,758,195 A * 7/1988 Walsh ..... A63H 33/04 401/196
4,870,721 A * 10/1989 Cohen ..... A44B 18/0053 24/16 PB
6,634,920 B1 * 10/2003 Michaelsen ..... A63H 33/04 446/128
6,997,771 B1 * 2/2006 Lucier ..... A63H 33/04 446/108
9,480,931 B1 * 11/2016 Samo ..... A63H 33/065
9,532,633 B1 * 1/2017 Tan ..... A45C 13/08

FOREIGN PATENT DOCUMENTS

| | | |
|---|---|---|
| DE | 202013104194 | 9/2013 |
| EP | 0621062 | 4/1994 |
| GB | 1316397 | 5/1971 |
| WO | WO2016134681 | 9/2016 |

* cited by examiner

*Primary Examiner* — Alexander Niconovich

(57) ABSTRACT

A flexible interconnectable block and fastener system includes a connector panel having a top side, a bottom side and a perimeter edge. The connector panel is resiliently flexible and is comprised of an elastomeric material. The perimeter edge includes a first end edge, a second end edge, a first lateral edge and a second lateral edge. The connector panel is elongated from the first end edge to the second end edge. A plurality of male interconnection members is integrally formed in and extends upwardly from the top side. The male interconnection members are arranged in a plurality of columns extending from the first end edge to the second end edge and rows extending between the first and second lateral edges wherein a number of the rows is equal to or less than a number of the columns.

9 Claims, 6 Drawing Sheets

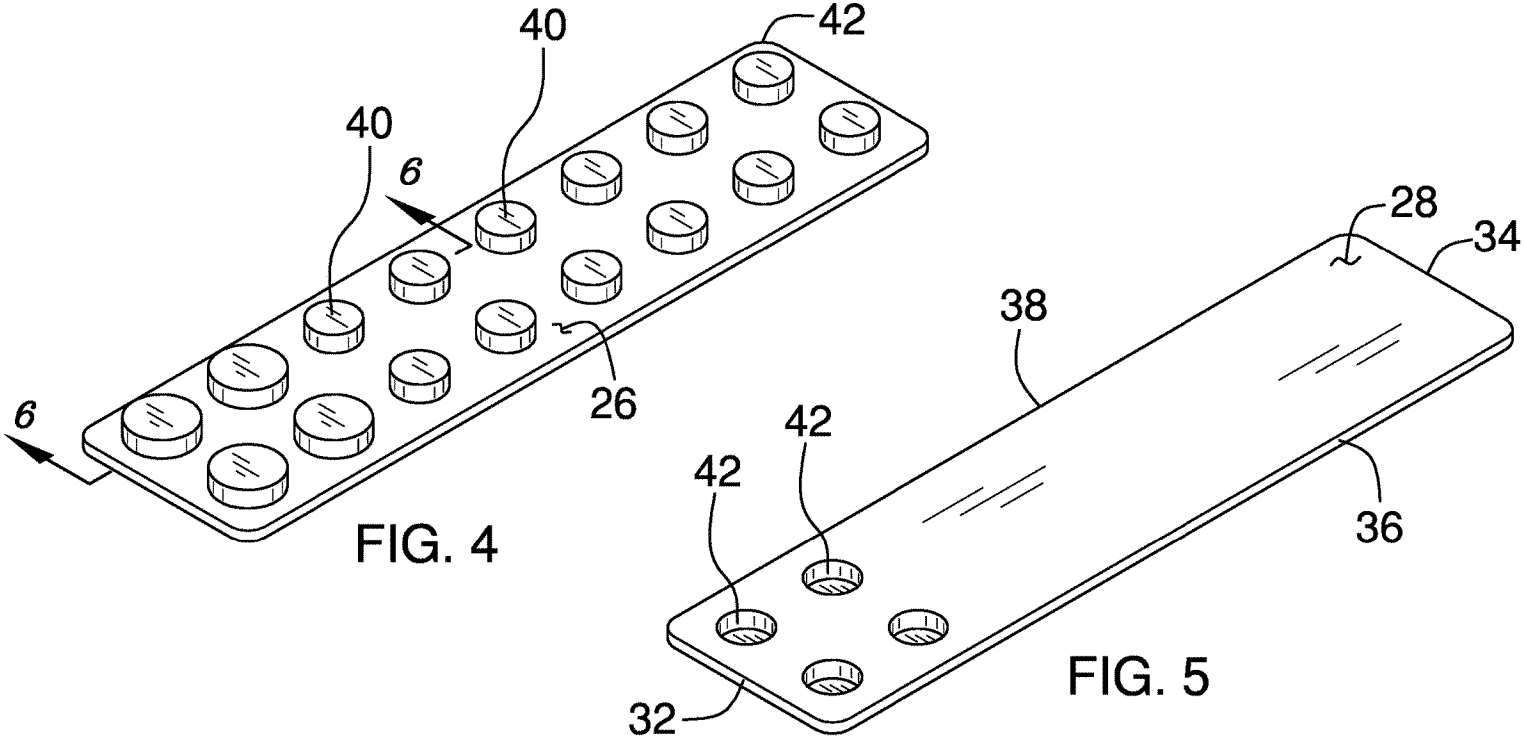
FIG. 5
FIG. 4
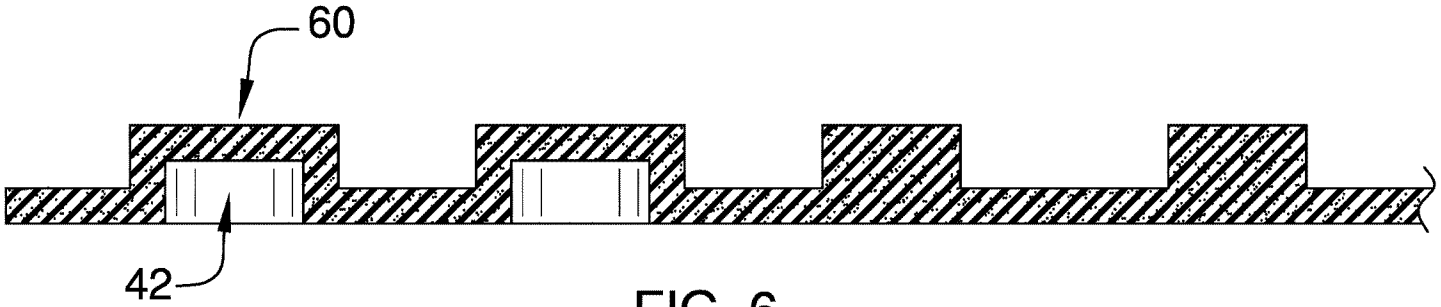
FIG. 6

FLEXIBLE INTERCONNECTABLE BLOCK AND FASTENER SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to flexible building block devices and more particularly pertains to a new flexible building block device for allowing male and female connectors to engage each other while allowing a block on which they are positioned to be freely bent into an arcuate shape.

BRIEF SUMMARY OF THE INVENTION

An embodiment of the disclosure meets the needs presented above by generally comprising a connector panel having a top side, a bottom side and a perimeter edge. The connector panel is resiliently flexible and is comprised of an elastomeric material. The perimeter edge includes a first end edge, a second end edge, a first lateral edge and a second lateral edge. The connector panel is elongated from the first end edge to the second end edge. A plurality of male interconnection members is integrally formed in and extends upwardly from the top side. The male interconnection members are arranged in a plurality of columns extending from the first end edge to the second end edge and rows extending between the first and second lateral edges wherein a number of the rows is equal to or less than a number of the columns.

An embodiment of the disclosure also meets the needs presented above by further comprising a connector panel having a top side, a bottom side and a perimeter edge. The connector panel is resiliently flexible and is comprised of an elastomeric material. The perimeter edge includes a first end edge, a second end edge, a first lateral edge and a second lateral edge. The connector panel is elongated from the first end edge to the second end edge. A plurality of female interconnection members extends upwardly into the bottom side. The female interconnection members are arranged in a plurality of columns extending from the first end edge to the second end edge and rows extending between the first and second lateral edges wherein a number of the rows is equal to or less than a number of the columns.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein:

FIG. 4 is a top perspective view of an embodiment of the disclosure.

FIG. 5 is a bottom perspective view of FIG. 4 of an embodiment of the disclosure.

FIG. 6 is a cross-sectional view of an embodiment of the disclosure taken along line 6-6 of FIG. 4.

DETAILED DESCRIPTION OF THE INVENTION

Figure 2:
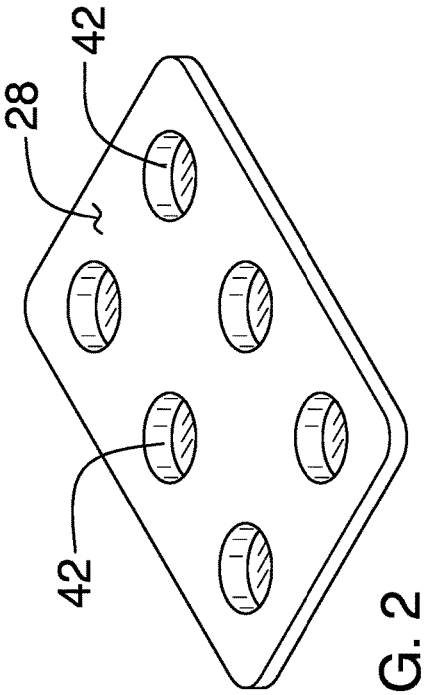
FIG. 2 is a bottom perspective view of an embodiment of the disclosure found in FIG. 1.

With reference now to the drawings, and in particular to FIGS. 1 through 12 thereof, a new flexible building block device embodying the principles and concepts of an embodiment of the disclosure and generally designated by the reference numeral 10 will be described.

As best illustrated in FIGS. 1 through 12, the flexible interconnectable block and fastener system 10 generally comprises connector panel 24 that may or may not be used in conjunction with a mat 12. The mat 12 has an upper surface 14 and a bottom surface 15 and is flexible and to allow the mat 12 to be positionable in a rolled condition or in a flat condition. The bottom surface 15 is generally planar and without any interconnection means. The rolled condition, as shown in FIG. 6, facilitates storage and transportation of the mat 12 and is defined as the mat 12 is rolled up into an approximate cylindrical or tubular shape. The mat 12 has a free edge 16 extending over and positioned adjacent to the upper surface when the mat 12 is in the rolled condition to define a flap portion 18 including the free edge 16 and a rolled portion 20 over which the flap portion 18 is positioned. A plurality of male protrusions 22 is integrally formed in and extending upwardly from the upper surface 14. The male protrusions 22 are arranged in a plurality of columns and rows. The plurality of columns and rows is at least eight rows and at least eight columns and will preferably include at least twelve rows and twelve columns.

The mat 12 is used with block systems by frictionally coupling the male protrusions 22 together with toy blocks 70. These toy blocks 70 are ubiquitous in the toy arts and are found in multiple references such as U.S. Pat. No. 3,005,282, though it should be understood that this reference depicts only one such block and some variations in sizes and shapes are known. These types of blocks may be found, for instance, sold under the trademarks Lego and Duplo. Generally, the male protrusions 22 extend into and frictionally engage the toy blocks 70 of type discussed in the patent reference above. Typically, these toy blocks 70 are themselves constructed of rigid plastics and are used with rigid plates. However, the mat 12 of the system 10 is comprised of a non-rigid elastomeric material such as natural rubber, synthetic rubbers, or, in particular, silicone polymers which are resiliently flexible. This allows a child to roll the mat 12 up when not in use which in turn provides an opportunity to use a much larger mat 12 than would be practical with respect to a rigid plate.

Figure 1:
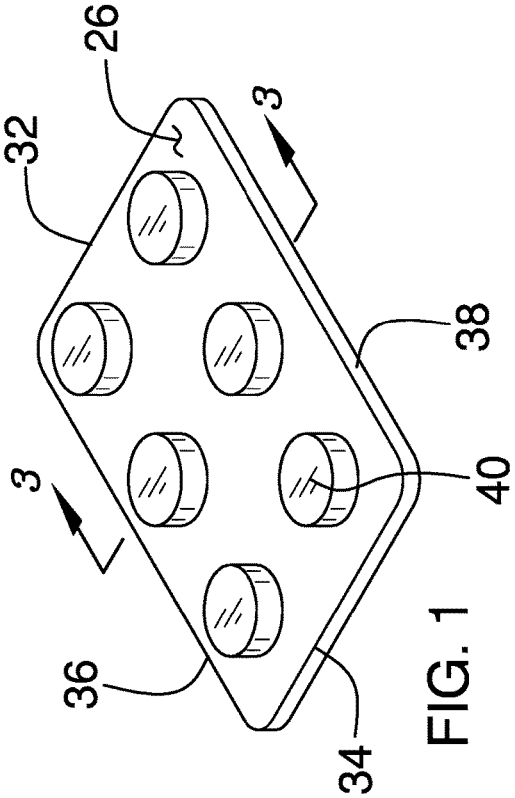
FIG. 1 is a top perspective view of a flexible interconnectable block and fastener system according to an embodiment of the disclosure.
Figure 7:
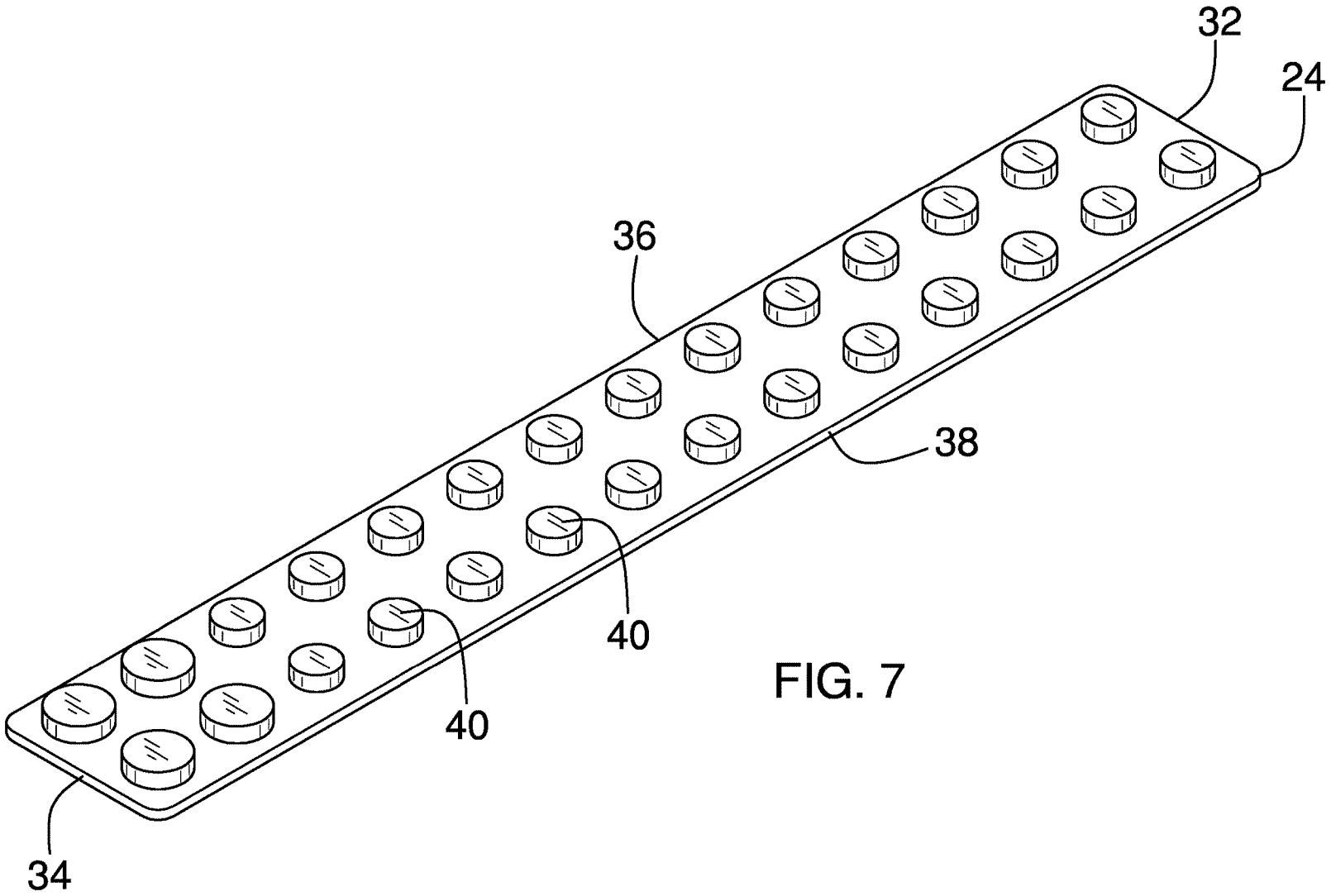
FIG. 7 is a top perspective view of an embodiment of the disclosure.

The connector panel 24 is provided and has a top side 26, a bottom side 28 and a perimeter edge 30. The connector panel 24 is resiliently flexible and is comprised of an elastomeric material and may again, in particular, be comprised of a silicone polymer or other similar material. The perimeter edge 30 includes a first end edge 32, a second end edge 34, a first lateral edge 36 and a second lateral edge 38. The connector panel 24 may be elongated from the first end edge 32 to the second end edge 34. The connector panel 24 has a width dimension from the first lateral edge 36 to the second lateral edge 38 and a height dimension from the top side 26 to the bottom side 28. The width dimension is preferably at least three times greater than the height dimension and typically the height dimension is less than 0.5 inches. Utilizing heights greater than 0.5 inches may prevent desired elastic properties of the connector panel 24, such as forming it into a partial or fully closed loop, as well as increase costs of manufacturing. As can be seen in FIGS. 1, 4 and 7, the connector panel 24 may be provided in any desirable length. The embodiment shown in FIG. 7, for example, may be best suited for being formed into a closed loop to be worn as a bracelet.

A plurality of male interconnection members 40 is integrally formed in and extends upwardly from the top side 26. The male interconnection members 40 are arranged into a plurality of columns extending from the first end edge 32 to the second end edge 34 and rows extending between the first 36 and second 38 lateral edges. The male interconnection members 40 each may have a shape resembling the male protrusions 22 on the mat 12. More particularly, each of the male interconnection members 40 comprises a protuberance having a geometric shape, wherein the geometric shape may, in particular, comprise a cylindrical shape. The plurality of columns may only comprise two columns and will generally comprise no more than six columns though three or less columns is typically preferred and the connector panel 24 may further be provided without any male interconnection members 40. It should be understood that the number of rows is of the male interconnection members 40 is equal to or great than the number or columns of the same. The male interconnection members 40 may have one or more rows having a greater diameter than remaining ones of the male interconnection members 40 for reasons discussed below.

A plurality of female interconnection members 42 extends upwardly into the bottom side 28. Each of the female interconnection members 42 releasably receives and frictionally engages one of the male interconnection members 40 or one of the male protrusions 22, depending on the usage of the connector panel 24 as described below. Each of the female interconnection members 42 has generally same geometric shape as the male interconnection members 40. Thus, if the male interconnection members 40 form an upwardly extending cylinder, the female interconnecting members 42 form a cylindrical well. At least two of the female interconnection members 42 is positioned adjacent to the first end edge 32 and at least two of the female interconnection members 42 may be positioned adjacent to the second end edge 34. Each of the female interconnection members 42 is aligned with one of the male interconnection members 40 and thus the female interconnection members 42 are also positioned in rows and columns. However, the number of male interconnection members 40 need not be equal to the number of female interconnection members 42. Moreover, the connector panel 24 may be formed without any male interconnection members 40.

Figure 3:
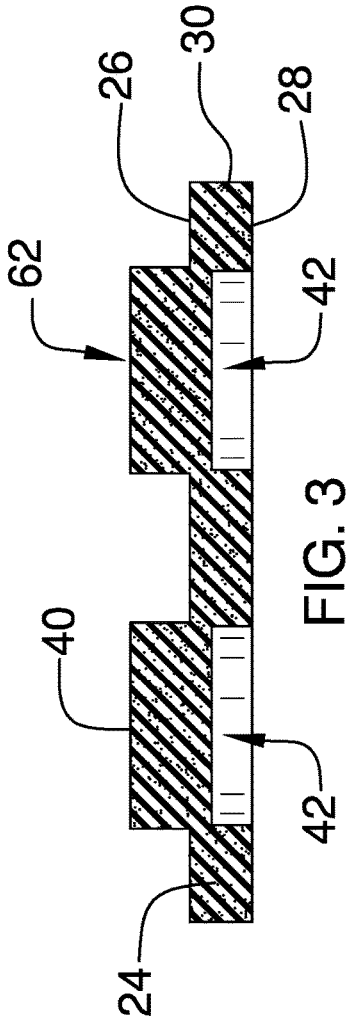
FIG. 3 is a cross-sectional view of an embodiment of the disclosure taken along line 3-3 of FIG. 1.
Figure 12:
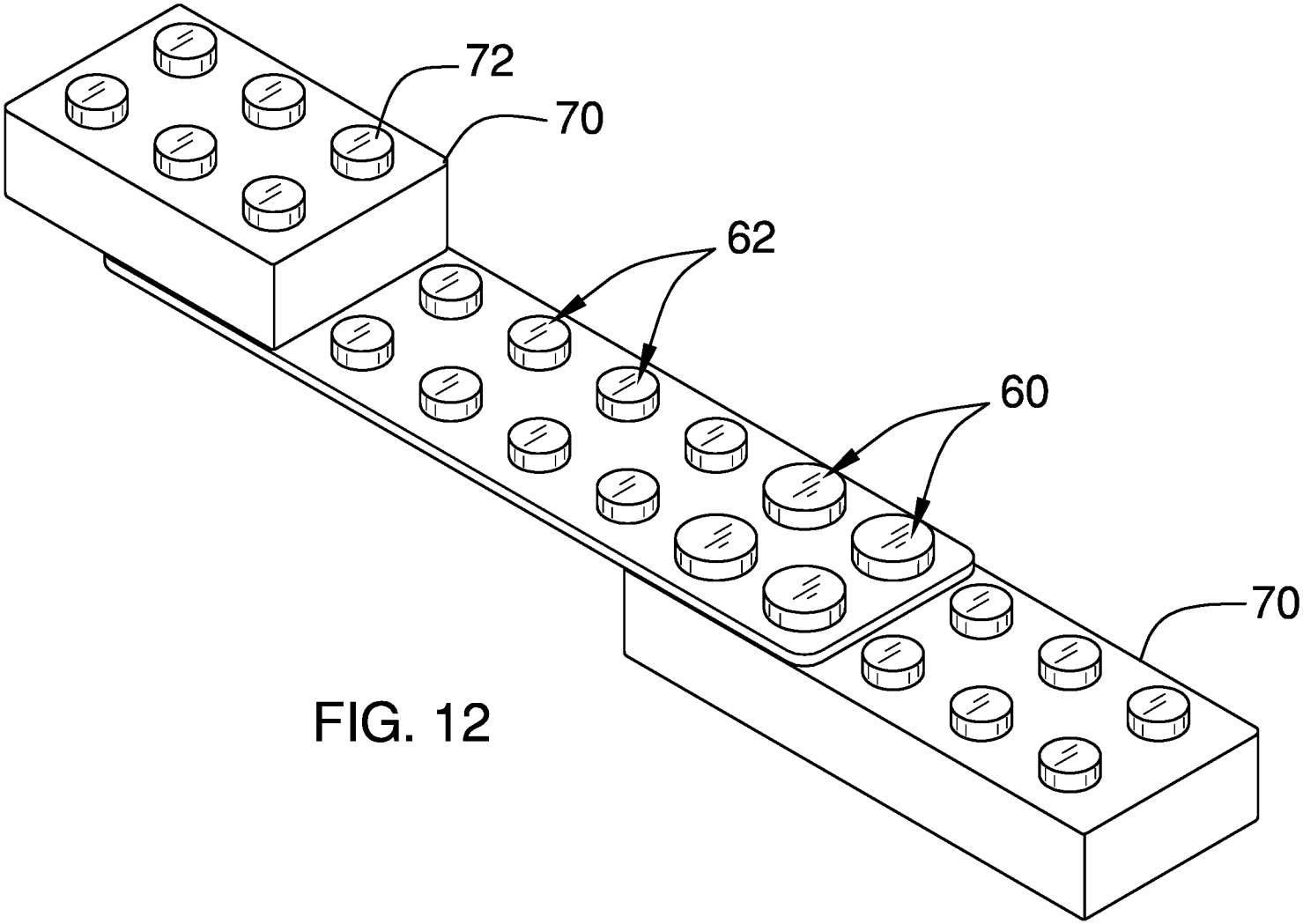
FIG. 12 is a top perspective in use view of the embodiment shown in FIG. 4 of the disclosure.

As stated above, the male interconnection members 40 may come in a variety of sizes wherein a first row or first two rows may be of a greater size than remaining ones of the rows of the male interconnection members 40. This is due the height restrictions of the connector panel 24. As can be seen in FIG. 6, some of the female interconnection members 42 extend into the male interconnection members 40 causing the male interconnection members to be wider than where the female interconnection members are shallower and do not extend above the top side 26 as shown in FIG. 3. The purpose of the larger female interconnection members 42 is to accommodate male connectors from larger toy blocks 70 while retaining the low profile of the connector panel 42. That is, the male connectors 72 from the larger toy blocks 70 would not be retained within shallow wells as shown in FIG. 3 and therefore the female interconnection members 42 must extend beyond the top side 26 to adequately engage these types of toy blocks 70. However, the larger male interconnection members 40 will not be able to engage those same toy blocks 70 as receivers on the toy blocks 70 will now be too small to receive them. For this reason and as best shown in FIG. 12, there has been defined large male connectors 60 and small male connectors 62 of the male interconnection members 40. The small male connectors 62 may be provided in addition to the large male connectors 42 as shown in FIGS. 4 and 7 to allow connection to female receivers of the toy blocks 70. The small male connector 62 may or may not have corresponding female interconnection members 42. FIGS. 4 through 6 show an embodiment wherein only female interconnection members 42 are shown which correspond to large male connectors 60. Furthermore, the connector panel 24 may instead be provided with smaller male 40 and female 42 interconnection members, as shown in FIGS. 1 through 3, each capable of engaging toy blocks 70 if the toy blocks 70 are of a smaller size and can subsequently extend into and adequately engage the female interconnection members 42.

Figure 11:
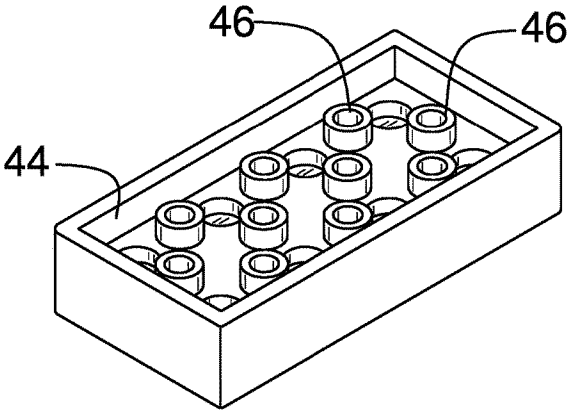
FIG. 11 is a bottom perspective view of FIG. 10 an embodiment of the disclosure.
Figure 10:
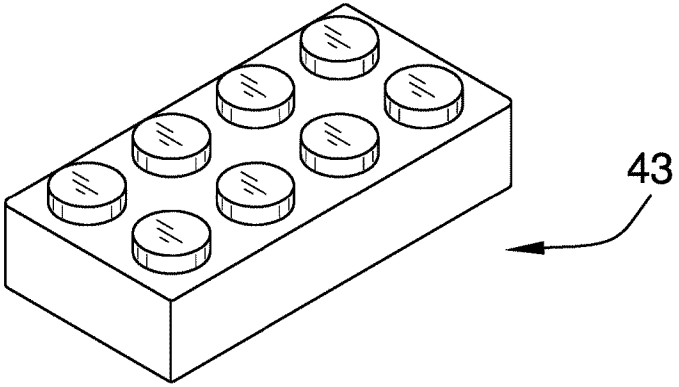
FIG. 10 is a top perspective view of an embodiment of the disclosure found in FIG. 3.
Figure 9:
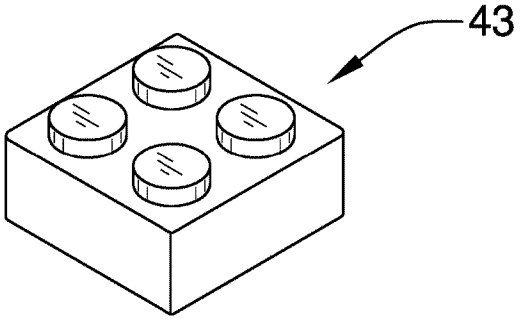
FIG. 9 is a top perspective view of an embodiment of the disclosure.

An embodiment of the invention is shown in FIGS. 9-11 which provides for connector panels 24 with male interconnection members 40 as well as a skirt 44 that extends downwardly from the top side 26 to form an interior space including walls or other extensions 46 attached to and extending downwardly from the top side 26. The extensions 46 include spaces between them for engaging male connectors 72 on the toy blocks 70. This embodiment is more similar to a conventional toy block 70 but will typically include a height restriction from the top side 26 to a distal edge of the skirt 44 which is still less than 0.5 inches and which will be of a unitary structure with the connector panel 24 and therefore be comprised of the same material as the connector panel 24.

In use, the system 10 and its structures may be used together or singularly in a number of manners. For example, FIGS. 1 and 2 show opposite sides of a same embodiment of the connector panel 24 wherein the bottom side 28 only includes two rows of female interconnection members 42. This embodiment may be utilized as a conventional building block with conventional toy blocs 70 or with other connector panels 24. The embodiment of FIG. 1 may be extended to any desired length and thereafter formed into a loop of any size with the user determining which male interconnection members 40 are to be received by the female interconnection members 42. The loop, once formed, may be worn as bracelet or used with toy blocks 70 which engage the male interconnection members 40. It should also be understood that the embodiment of the connector panel 24 found in FIGS. 1 and 2 may come in any number of rows depending on the size of connector panel 24 being utilized but with an equal number of male 40 and female 42 interconnection members.

The embodiments shown in FIGS. 1-7 may be used as bridges or connectors between toy blocks 70 as shown in FIG. 12 wherein the male 40 and female 42 interconnection members are included or excluded and sized depending on the usage or the connector panel 70 and the types of toy blocks 70 being utilized. For example, FIG. 12 shows the embodiment of FIG. 4 being utilized with toy blocks 70. However, the embodiment of FIG. 1 could be used in a similar manner with toy blocks 70 having smaller male connectors 72. Additionally, multiple ones of the connector panel 24 shown in FIG. 12 may be combined together to effectively increase a length of a flexible "bridge" between two toy blocks 72.

Figure 8:
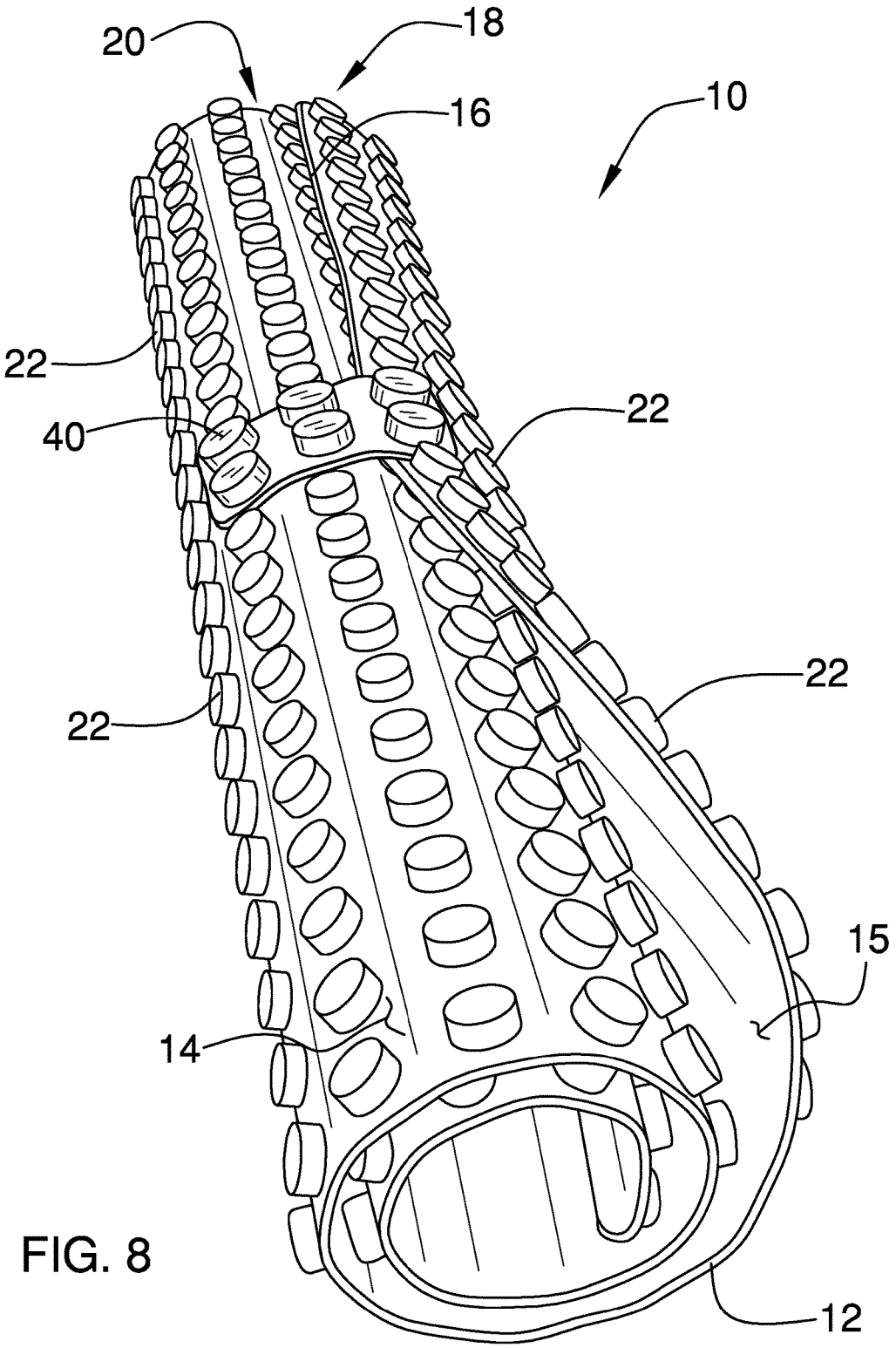
FIG. 8 is a top perspective view of an embodiment of the disclosure found in FIG. 1.

Another usage of the connector panel 24 is with the mat as found in FIG. 8. In this use of the system 10, each of the female interconnection members 42 releasably receives and frictionally engages one of the male protrusions 40. The connector panel 24 is removably positioned over the free edge 16 and engages at least one male protrusion 22 on the flap portion 18 and one male protrusion 22 on the rolled portion 20 to releasably retain the mat 12 in the rolled condition. The connector panel 24 thereby prevents unrolling of the mat 12 and retains such in the rolled condition for transportation and storage.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A building block assembly comprising:

a connector panel having a top side, a bottom side and a perimeter edge, said connector panel being resiliently flexible and being comprised of an elastomeric material, said perimeter edge including a first end edge, a second end edge, a first lateral edge and a second lateral edge, said connector panel being elongated from said first end edge to said second end edge;

a plurality of male interconnection members being integrally formed in and extending upwardly from said top side, said male interconnection members being arranged in a plurality of columns extending from said first end edge to said second end edge and rows extending between said first and second lateral edges wherein a number of said rows is equal to or less than a number of said columns;

said plurality of male interconnection members each having a cylindrical shape; and said plurality of male interconnection members including small male interconnection members and large male interconnection members, a diameter of said small interconnection members being less than a diameter of said large male interconnection members.

2. The building block assembly according to claim 1, wherein said connector panel has a width dimension from said first lateral edge to said second lateral edge, said connector panel having a height dimension from said top side to said bottom side, said width dimension being at least three times great than said height dimension.

3. The building block assembly according to claim 1, further including a plurality of female interconnection members extending upwardly into said bottom side.

4. The building block assembly according to claim 3, wherein at least two of said female interconnection members are positioned adjacent to said first end edge.

5. The building block assembly according to claim 4, wherein at least two of said female interconnection members are positioned adjacent to said second end edge.

6. The building block assembly according to claim 3, wherein each of said female interconnection members is aligned with one of said male interconnection members.

7. The building block assembly according to claim 1, wherein said elastomeric material is a silicone polymer.

8. A building block assembly comprising:

a connector panel having a top side, a bottom side and a perimeter edge, said connector panel being resiliently flexible and being comprised of an elastomeric material, said perimeter edge including a first end edge, a second end edge, a first lateral edge and a second lateral edge, said connector panel being elongated from said first end edge to said second end edge, said connector panel having a width dimension from said first lateral edge to said second lateral edge, said connector panel having a height dimension from said top side to said bottom side, said width dimension being at least three times greater than said height dimension;

a plurality of male interconnection members being integrally formed in and extending upwardly from said top side, said male interconnection members being arranged in a plurality of columns extending from said first end edge to said second end edge and rows extending between said first and second lateral edges, each of said male interconnection members comprising a protuberance having a geometric shape, said geometric shape comprising a cylindrical shape, said plurality of columns comprising only two columns;

a plurality of female interconnection members extending upwardly into said bottom side, each of said female interconnection members releasably receiving and frictionally engaging one of said male interconnection members, each of said female interconnection members having a same geometric shape as said male interconnection members, at least two of said female interconnection members being positioned adjacent to said first end edge, at least two of said female interconnection member being positioned adjacent to said second end edge, each of said female interconnection members being aligned with one of said male interconnection members;

said plurality of male interconnection members each having a cylindrical shape; and said plurality of male interconnection members including small male interconnection members and large male interconnection members, a diameter of said small interconnection members being less than a diameter of said large male interconnection members.

9. The building block assembly according to claim 8, wherein said elastomeric material is a silicone polymer.

* * * * *